US009702236B2

(12) United States Patent
Ojagbohunmi

(10) Patent No.: US 9,702,236 B2
(45) Date of Patent: Jul. 11, 2017

(54) HEAT-ASSISTED STEAM-BASED HYDROCARBON RECOVERY METHOD

(71) Applicant: Husky Oil Operations Limited, Calgary (CA)

(72) Inventor: Samuel Ojagbohunmi, Calgary (CA)

(73) Assignee: Husky Oil Operations Limited, Calgary, Alberta (CA)

( * ) Notice: Subject to any disclaimer, the term of this patent is extended or adjusted under 35 U.S.C. 154(b) by 0 days.

(21) Appl. No.: 14/243,292

(22) Filed: Apr. 2, 2014

(65) Prior Publication Data

US 2015/0285047 A1 Oct. 8, 2015

(51) Int. Cl.
*E21B 43/24* (2006.01)

(52) U.S. Cl.
CPC ..... *E21B 43/24* (2013.01)

(58) Field of Classification Search
CPC ..... E21B 43/2401; E21B 43/24; E21B 36/04; E21B 33/13; E21B 36/00; E21B 47/122
USPC ..... 166/293, 248, 272.1, 302, 60, 66.5
See application file for complete search history.

(56) References Cited

U.S. PATENT DOCUMENTS 3,946,809 A * 3/1976 Hagedorn ..... E21B 43/18 166/248
4,084,637 A * 4/1978 Todd ..... 166/245
5,339,898 A 8/1994 Yu et al.
2007/0175638 A1* 8/2007 Crichlow ..... 166/302
2009/0194269 A1* 8/2009 Vinegar ..... E21B 43/24 166/60
2011/0186295 A1* 8/2011 Kaminsky ..... E21B 43/24 166/302
2011/0253363 A1* 10/2011 Banerjee et al. ..... 166/248
2012/0305239 A1* 12/2012 Sultenfuss et al. ..... 166/248

FOREIGN PATENT DOCUMENTS

WO WO 2012/037334 3/2012

OTHER PUBLICATIONS

McGee, et al., "Electrical hearing with horizontal wells, the heat transfer problem," Society of Petroleum Engineers Paper No. SPE 37117 (1996), 14 pgs.
McGee, et al., "Field test of electrical heating with horizontal and vertical wells," Journal of Canadian Petroleum technology, vol. 38, No. 3, Mar. 1999, 8 pgs.
McGee, et al., "The mechanisms of electrical heating for the recovery of bitumen form oil sands," Journal of Canadian Petroleum Technology, vol. 46, No. 1, Jan. 2007, 7 pgs.
Vinsome, et al., "Electrical Heating," Journal of Canadian Petroleum technology, vol. 33, No. 4, Apr. 1994, 8 pgs.

* cited by examiner

*Primary Examiner* — Silvana Runyan
(74) *Attorney, Agent, or Firm* — Frost Brown Todd LLC

(57) ABSTRACT

A method for recovering subsurface hydrocarbons, including heavy oil or bitumen, wherein a downhole steam injection phase is followed by application of heat to the near-wellbore region of the reservoir, heat being applied only during periods without steam injection. The heat application can be achieved by any number of techniques including electrical heaters, radio frequency waves, electromagnetic waves and microwaves. Numerous advantages are possible by withholding heat application during the steam injection phase. While preferred for use with cyclic steam stimulation recovery techniques, the method can be applied with other steam-based recovery techniques.

27 Claims, 11 Drawing Sheets

5

| Table 1: Relative Permeability | | | | | |
|---|---|---|---|---|---|
| Sw | krw | krow | Sl | krg | krog |
| 0.190 | 0.000 | 1.000 | 0.240 | 1.000 | 0.000 |
| 0.200 | 0.001 | 0.960 | 0.283 | 0.855 | 0.000 |
| 0.300 | 0.008 | 0.720 | 0.298 | 0.807 | 0.000 |
| 0.400 | 0.025 | 0.470 | 0.389 | 0.554 | 0.002 |
| 0.500 | 0.070 | 0.240 | 0.449 | 0.416 | 0.010 |
| 0.600 | 0.148 | 0.100 | 0.555 | 0.229 | 0.051 |
| 0.700 | 0.271 | 0.030 | 0.585 | 0.187 | 0.073 |
| 0.750 | 0.352 | 0.015 | 0.630 | 0.134 | 0.116 |
| 0.800 | 0.447 | 0.005 | 0.782 | 0.027 | 0.385 |
| 0.850 | 0.559 | 0.000 | 0.887 | 0.002 | 0.729 |
| 0.900 | 0.687 | 0.000 | 0.918 | 0.000 | 0.857 |
| 0.950 | 0.834 | 0.000 | 0.933 | 0.000 | 0.927 |
| 1.000 | 1.000 | 0.000 | 0.948 | 0.000 | 1.000 |

FIG. 10

| Rock | | | Pore | | | | | |
|---|---|---|---|---|---|---|---|---|
| Reservoir Temperature | 12 | C | Reservoir Temperature | 12 | C | | | |
| porosity | 0.34 | | porosity | 0.34 | | | | |
| block volume | 89 | m3 | block volume | 25 | m3 | | | |
| Rock Heat Capacity | 2.35E+06 | J/(m3*C) | Water Heat Capacity | 5.35E+04 | J/(m3*C) | | | |
| Temperature (TEMPSET) | 220 | C | Temperature (TEMPSET) | 220 | C | | | |
| | 2.9E+10 | J | + | 9.5E+07 | J | = | 2.9E+10 | J |
| Circ. Period | 45 | days | | HEATR | 6.4E+08 | J/day | | |
| | | | | HEATR | 6.4E+08 | J/day | | |
| | | | (HEATR/Delta T) | DHTR | 5.4E+06 | J/(day*C) | | |

FIG. 11

| Cases | Cum Oil ($Mm^3$) | Added Value ($Mm^3$) | CSOR ($m^3/m^3$) | DI ($m^3/m^3$) |
|---|---|---|---|---|
| CSS Only | 54.50 | - | 3.5 - 4.3 | 0.25 - 0.27 |
| CSS + Heater | 82.19 | 27.69 | 2.2 - 3.6 | 0.30 - 0.45 |

FIG. 16

HEAT-ASSISTED STEAM-BASED HYDROCARBON RECOVERY METHOD

FIELD OF THE INVENTION

The present invention relates to methods for hydrocarbon recovery from a subsurface reservoir, and specifically to recovery of heavy hydrocarbon deposits using steam-based recovery techniques.

BACKGROUND OF THE INVENTION

In the field of subsurface hydrocarbon production, it is known to employ various stimulation procedures and techniques to enhance production. For example, in the case of heavy oil and bitumen housed in subsurface reservoirs, conventional drive mechanisms may be inadequate to enable production to surface, and it is well known to therefore inject steam or steam-solvent mixtures to make the heavy hydrocarbon more amenable to movement within the reservoir permeability pathways, by heating the hydrocarbon and/or mixing it with lighter hydrocarbons or hot water.

Cyclic steam stimulation (CSS) is one of the most promising thermal recovery methods for producing high viscosity oil or bitumen. This oil recovery method requires a predetermined amount of steam to be injected into a well or wells drilled into the hydrocarbon deposit, which well or wells are then shut in to allow the steam and heat to soak into the reservoir surrounding the well and create what is known as a "steam chamber". This assists the natural reservoir energy by thinning the oil (or, in the case of a steam-solvent injection, also mixing the heavy hydrocarbon with lighter hydrocarbons) so that it will more easily move into the production well or wells. Once the reservoir has been adequately heated and the steam chamber has been created, the production wells can be put back into production until the injected heat has been mostly dissipated within the fluids being produced and the surrounding reservoir rock and fluids. This cycle can then be repeated until the natural reservoir pressure has declined to a point that production is uneconomic, or until increased water production occurs.

Recovery from a CSS well depends on a number of factors, including the production rate for each phase and how long each is sustained. The production rate in turn depends on factors such as the viscosity of the hydrocarbon being produced, the permeability of the reservoir rock and the inflow performance.

Recovery of heavy hydrocarbons such as bitumen requires both mobilizing the hydrocarbon, and then displacing it from the initial position to the drainage points, the producing wells. Displacement is impacted by how mobilised hydrocarbon, condensed water and steam push each other through the reservoir. Each fluid has its own mobility, which depends in part on its viscosity and the permeability available to the fluid. Mobility depends on reservoir rock permeability, pore size distribution, fluid saturation and fluid viscosity. The mobility is a measure of how easy it is for a fluid with a particular viscosity to flow through a rock of a given permeability (Equation 1 below). Each fluid can only flow in its own part of the pore space, and the absolute or rock permeability must be reduced by the appropriate relative permeability to account for the presence of other fluids.

$$\text{Mobility} = \frac{k_{abs} k_r}{\mu} \quad (1)$$

where $k_{abs}$ is the absolute permeability in millidarcies (mD), $k_r$ is the relative permeability and $\mu$ is the fluid viscosity.

The reduction in this relative permeability greatly affects the ability of the hydrocarbon to be produced at the wellbore.

The movable oil volume (MOV) for each CSS cycle is given by:

$$\text{MOV} = \text{PV} * (1 - S_{wc} - S_{orw}) \quad (2)$$

where PV is the total pore volume available for occupation, $S_{wc}$ is the connate or irreducible water and $S_{orw}$ is the residual oil saturation.

Compaction in a reservoir causes reduction in the movable oil volume as more oil and water are trapped in the pores, whereas dilation increases the movable oil volume. Dilation decreases the residual oil saturation, while the connate water saturation may initially increase to dilate the reservoir grains and later decrease at higher pore volume.

The production of heat from the reservoir also forces the density and viscosity of the downhole hydrocarbon to increase. The former then reduces the rate of hydrocarbon production by decreasing the efficiency of the lifting techniques used, while the latter decreases mobility to the wellbore. This zone of high viscosity that develops in the low-pressure region near the wellbore is commonly referred to as "visco-skin".

Since at least the 1970s, the use of electrical heaters has been studied for application in heavy oil production. It has been proposed that electrical heaters be introduced in the near-wellbore region of a hydrocarbon production well to optimize production by reducing bitumen viscosity and density resulting from temperature decline and permeability reduction. See for example U.S. Pat. No. 5,339,898 to Yu et al. In the case of visco-skin and reduced productivity, electrical resistance heating has been proposed as a possible solution; see for example Vinsome et al., "Electrical heating", Journal of Canadian Petroleum Technology, vol. 33, no. 4, April 1994. It has also been noted in the technical literature that continuous, non-cyclic, application of electrical heating has been attempted on several occasions with encouraging results; see for example McGee et al., "Electrical heating with horizontal wells, the heat transfer problem," Society of Petroleum Engineers Paper No. SPE 37117 (1996); McGee et al., "Field test of electrical heating with horizontal and vertical wells," Journal of Canadian Petroleum Technology, vol. 38, no. 3, March 1999; McGee et al., "The mechanisms of electrical heating for the recovery of bitumen from oil sands." Journal of Canadian Petroleum Technology, vol. 46, no. 1, January 2007.

However, the use of electrical heaters appears to have certain disadvantages. For example, the cost of running electrical heaters may be undesirably high depending on the number of wells in production in a given reservoir. Also, the utility of certain types of heaters may be negatively impacted by the presence of steam, which presence is a key driver in a number of thermal recovery methods such as CSS.

SUMMARY OF THE INVENTION

The present invention is accordingly directed to applying heat only during those phases of a steam-based recovery technique when steam is not being injected into the reservoir.

According to a first aspect of the present invention, then, there is provided a method for recovering a hydrocarbon from a reservoir, the method comprising the steps of:

a. drilling at least one well from surface to the reservoir;
b. injecting steam down the at least one well to the reservoir;
c. after injecting the steam, applying heat to a portion of the reservoir adjacent the well;
d. allowing the steam to elevate the temperature of the reservoir and the hydrocarbon while applying the heat; and
e. producing a portion of the hydrocarbon to the surface while applying the heat.

In some exemplary embodiments of the first aspect, the hydrocarbon is preferably a heavy hydrocarbon, which heavy hydrocarbon may be heavy crude oil or bitumen. The at least one well may be a single well used for both injection and production, or it may comprise at least two wells, at least one of which is an injector well and at least one of which is a producer well.

Exemplary embodiments of the first aspect may further comprise a step f. in which application of the heat is ceased after producing the portion of the hydrocarbon, and further exemplary embodiments may comprise repeating steps a. through f. as desired. Exemplary embodiments may further comprise the step of maintaining reservoir temperature above 80 degrees Celsius in the portion of the reservoir adjacent the well, and the heat being applied may arise from means selected from the group consisting of electrical heaters, radio frequency waves, electromagnetic waves, and microwaves.

According to a second aspect of the present invention, there is provided a method for recovering a hydrocarbon from a reservoir having at least one injector well therein, the method comprising the steps of:

a. injecting steam down the at least one injector well to the reservoir;
b. after injecting the steam, applying heat to a portion of the reservoir adjacent the injector well; and
c. producing a portion of the hydrocarbon to the surface while applying the heat.

In some exemplary embodiments of the second aspect, the hydrocarbon is preferably a heavy hydrocarbon, which heavy hydrocarbon may be heavy crude oil or bitumen. The at least one injector well may be a single injector well used for both injection and production, or it may comprise at least two injector wells, at least one of which is also configured for use as a producer well.

Exemplary embodiments of the second aspect may further comprise a step d. in which application of the heat is ceased after producing the portion of the hydrocarbon, and further exemplary embodiments may comprise repeating steps a. through d. as desired. Exemplary embodiments may further comprise the step of maintaining reservoir temperature above 80 degrees Celsius in the portion of the reservoir adjacent the injector well, and the heat being applied may arise from means selected from the group consisting of electrical heaters, radio frequency waves, electromagnetic waves, and microwaves.

According to a third aspect of the present invention, there is provided a method for recovering a hydrocarbon from a reservoir having at least one injector well therein, the method comprising the steps of:

a. injecting steam down the at least one injector well to the reservoir;
b. shutting in the at least one injector well and allowing the injected steam to elevate the temperature of the reservoir and the hydrocarbon in the reservoir;
c. during shutting in of the at least one injector well, applying heat to a portion of the reservoir adjacent the at least one injector well; and
d. producing a portion of the hydrocarbon to the surface while applying the heat.

In some exemplary embodiments of the third aspect, the hydrocarbon is preferably a heavy hydrocarbon, which heavy hydrocarbon may be heavy crude oil or bitumen. The at least one injector well may be a single injector well used for both injection and production, or it may comprise at least two injector wells, at least one of which is also configured for use as a producer well.

Exemplary embodiments of the third aspect may further comprise a step e. in which application of the heat is ceased after producing the portion of the hydrocarbon, and further exemplary embodiments may comprise repeating steps a. through e. as desired. Exemplary embodiments may further comprise the step of maintaining reservoir temperature above 80 degrees Celsius in the portion of the reservoir adjacent the injector well, and the heat being applied may arise from means selected from the group consisting of electrical heaters, radio frequency waves, electromagnetic waves, and microwaves.

According to a fourth aspect of the present invention, there is provided a method for reducing hydrocarbon viscosity in a near-wellbore region of a hydrocarbon reservoir having at least one well therein, thereby enhancing hydrocarbon recovery, the method comprising the steps of:

a. injecting steam down the at least one well to the reservoir;
b. after injecting the steam, applying heat to at least a portion of the near-wellbore region of the hydrocarbon reservoir; and
c. allowing the heat to reduce the viscosity of hydrocarbon in the near-wellbore region of the hydrocarbon reservoir.

In some exemplary embodiments of the fourth aspect, the hydrocarbon is preferably a heavy hydrocarbon, which heavy hydrocarbon may be heavy crude oil or bitumen. Exemplary embodiments may further comprise the step of maintaining reservoir temperature above 80 degrees Celsius in the near-wellbore region of the hydrocarbon reservoir, and the heat being applied may arise from means selected from the group consisting of electrical heaters, radio frequency waves, electromagnetic waves, and microwaves.

A detailed description of an exemplary embodiment of the present invention is given in the following. It is to be understood, however, that the invention is not to be construed as being limited to this embodiment.

BRIEF DESCRIPTION OF THE DRAWINGS

In the accompanying drawings, which illustrate an exemplary embodiment of the present invention:

FIG. 10 is a table with relative permeability values used in a simulation test;

FIG. 11 is a table showing simulation test data;

FIG. 16 is a table summarizing production data from a simulation test.

An exemplary embodiment of the present invention will now be described with reference to the accompanying drawings.

DETAILED DESCRIPTION

In the following detailed description, a specific application of the present invention is described, in particular an application for use with a CSS recovery method for bitumen housed in a subsurface reservoir. However, it will be clear to those skilled in the art that other applications are possible within the scope of the present invention, including unique operating conditions and parameters specific to a particular reservoir context. That being the case, the following description is intended to be exemplary and non-limiting.

The present invention is intended for use with heavy hydrocarbons such as heavy oil and bitumen, although it can be used with lighter oils in appropriate circumstances that would be clear to one skilled in the art. Heavy and extra-heavy crude oils and bitumens are composed primarily of hydrocarbons, but they may also contain high molecular weight aliphatic and terpenoid hydrocarbons, asphaltenes, and oxygen-, nitrogen- and sulfur-bearing compounds. Heavy oils and bitumens are commonly defined and characterized on the basis of both viscosity and density, and those skilled in the art will know of accepted viscosity and density ranges.

Figure 1:
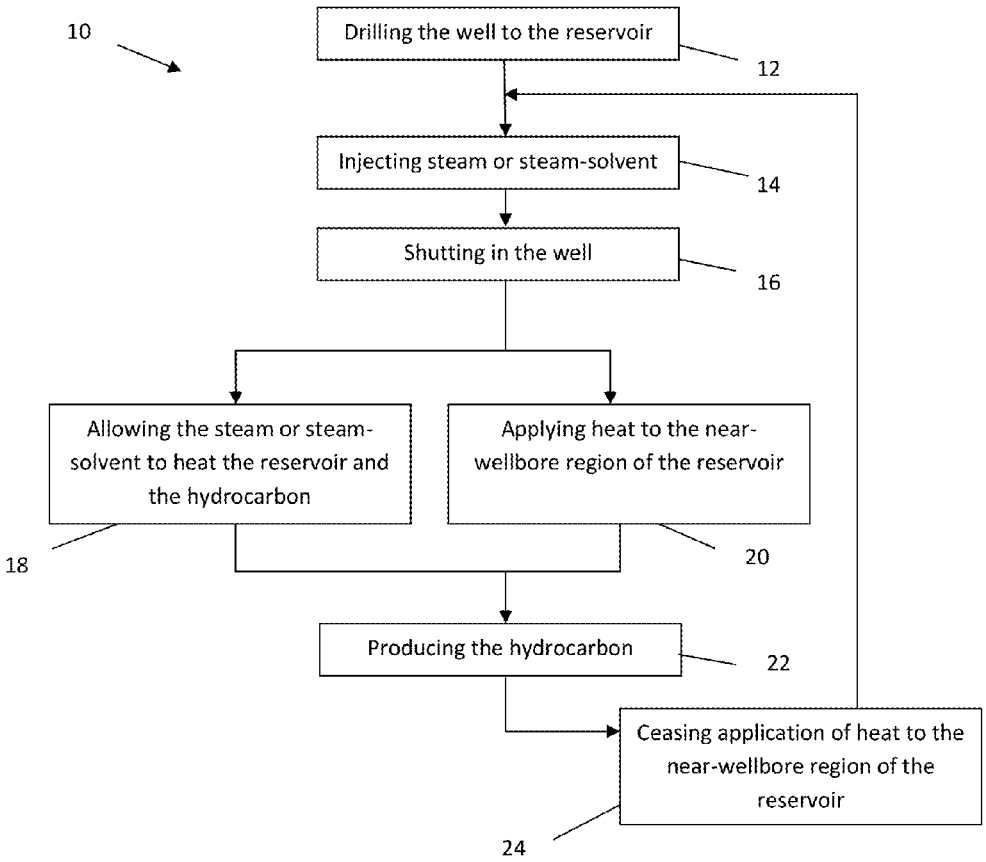
FIG. 1 is a flowchart illustrating an exemplary method according to the present invention.

Turning to FIG. 1, an exemplary method 10 according to the present invention is illustrated. The method 10 begins with the step 12 of drilling a well into the reservoir to access the hydrocarbon deposit. Note that where the term "well" is used herein, it can mean either a vertical well or a horizontal well, and the term "wells" can mean vertical and/or horizontal wells or a combination of vertical and horizontal wells, as would be obvious to one skilled in the art. Once the well has been completed, steam is injected downhole at step 14. The skilled person will know how to manage steam injection in a thermal hydrocarbon recovery operation. A mixture of steam and a selected solvent could also be used for this step, as is well known in the art. As the exemplary method is described in the context of a CSS operation, the next step 16 is shutting in the well. The injected steam is then allowed to heat the bitumen deposit at step 18.

After steam injection has been completed at step 14, heat is applied to the near-wellbore region of the reservoir at step 20. As indicated above, the heat could be applied by any number of techniques, including for non-limiting example electrical heaters, radio frequency waves, electromagnetic waves, and microwaves, and one skilled in the art would be able to determine which technique would be appropriate for a given context. While this step 20 is illustrated as occurring after shut-in of the well and simultaneously with the so-called "steam soak" of step 18, the heat could be applied at or before the time of shut-in, as long as the steam injection has ceased.

After the steam soak phase of the CSS method, and while heat continues to be applied, the hydrocarbon is produced to surface at step 22. Production may occur through the same well that was used for injection at step 14, or it could be a separate well, as would be known to those skilled in the art. Heat losses are common during production, and the continued application of heat during production counters this to at least an extent, thereby helping to prevent visco-skin formation and increased viscosity in the near-wellbore region.

After the target hydrocarbon has been mobilized and produced, the cycle can be repeated. However, before the next round of steam (or steam-solvent) injection, the heat application is terminated at step 24. Although not shown, it is also possible to repeat the discrete steam injection and heat application cycles one or more times before initial production.

Figure 2:
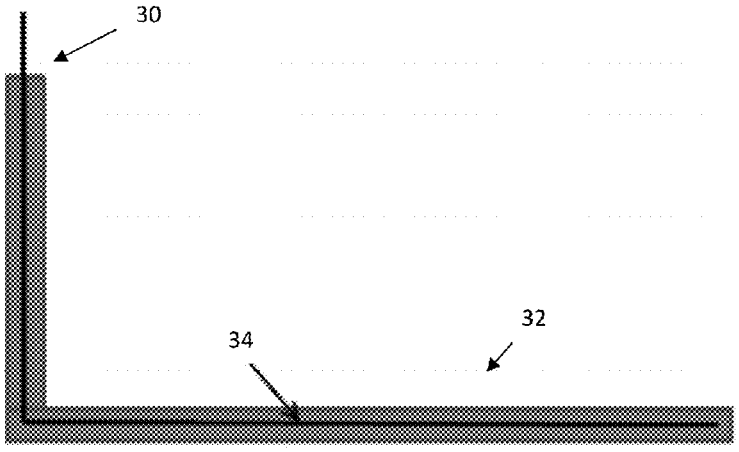
FIG. 2 is a simplified elevation view showing placement of an exemplary heater on a horizontal leg of a well.

The exemplary method involves installation of an electrical heater inside a vertical or horizontal wellbore, as shown in FIG. 2. The well 30 comprises a horizontal leg 32 extending at least partially through a target reservoir. The horizontal leg 32 is provided with an electrical heater 34 in a manner known to those skilled in the art.

Figure 3:
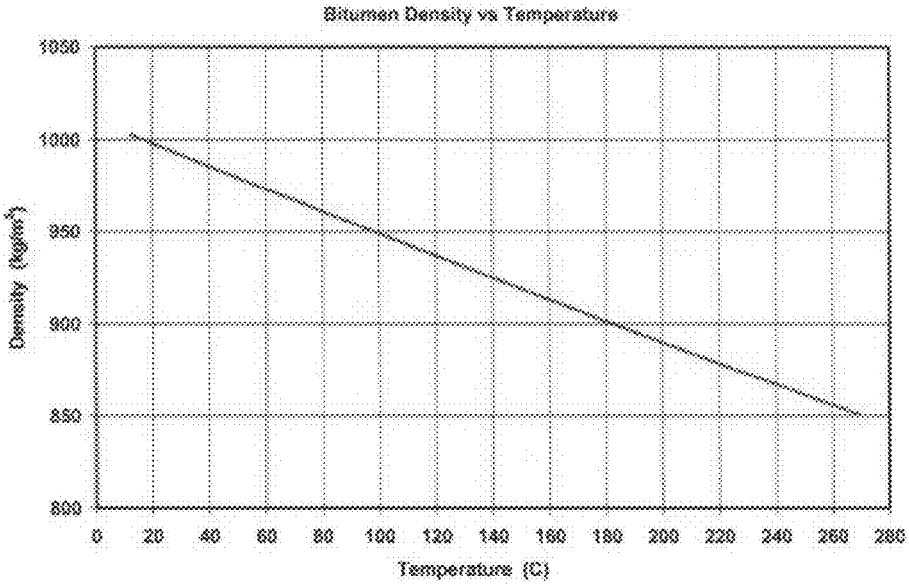
FIG. 3 is a chart illustrating the change in bitumen density as a function of temperature.
Figure 4:
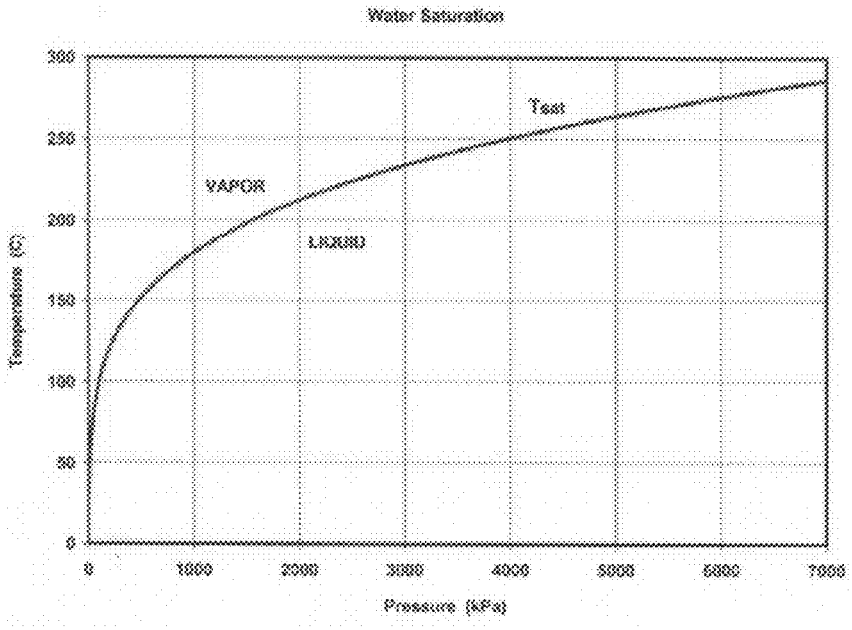
FIG. 4 is a chart illustrating a temperature-pressure saturation curve.
Figure 5:
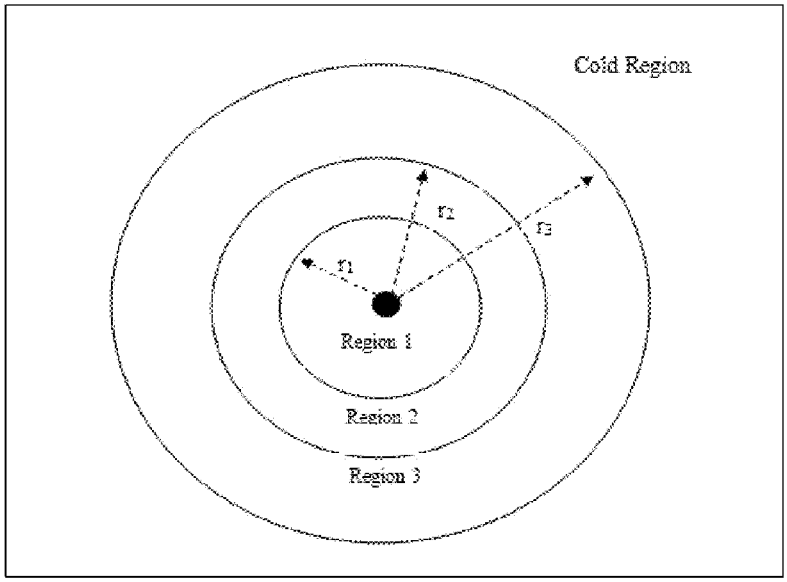
FIG. 5 is an idealised CSS region illustration.

The heat source is used in optimizing production from the wellbore and the near-wellbore region. Optimal benefit strongly depends on near-wellbore bitumen mobilization, flashing, dilation and temperature dependent end points. As those skilled in the art will know, a decrease in the temperature increases the residual oil saturation, and decreases the permeability to oil. This negative effect on these temperature dependent end points is arrested during the production phase. The efficiency of the flow pump is also enhanced by reducing the viscosity of the near-wellbore bitumen due to heating as shown in FIG. 3. As the pressure declines especially in the wellbore region during the production phase, condensed water is flashed to vapour, as is illustrated by the temperature-pressure saturation curve in FIG. 4. To maximize the efficiency of the pump, it is desirable to operate the heat source to maintain water in a liquid state based on the drawdown pressure. Turning to an idealised CSS region illustration in FIG. 5, the temperature increase in the near-wellbore region due to the electric heater creates a pseudo-steady state heat flux region in Region 1, and the rate of decline in temperature in Regions 2 and 3 of the reservoir is accordingly reduced despite the heat production from the reservoir. The bitumen mobility in the near-wellbore region in this case is enhanced due to the reduction in viscosity and temperature dependent end points, unlike conventional CSS processes where a decline in reservoir pressure often creates recompaction which reduces the movable oil volume in the near-wellbore region.

As stated above, applying heat to the near-wellbore region of the reservoir can be used to reduce visco-skin formation and undesirable viscosity levels generally. The actual target temperature for the near-wellbore region will be situation-specific, and it may vary based on a number of factors including the reservoir type and the type and general density of the hydrocarbon in the reservoir. In the case of bitumen in a carbonate formation, for example, it might be advantageous to maintain the near-wellbore region at no less than 80 degrees Celsius. As the target temperature may be determined on a case-by-case basis, exemplary methods according to the present invention may also incorporate the use of temperature monitoring techniques and equipment known to those skilled in the art. When a drop in temperature occurs, that might for example be used as an indication that steam injection for the next cycle can commence.

Figure 6:
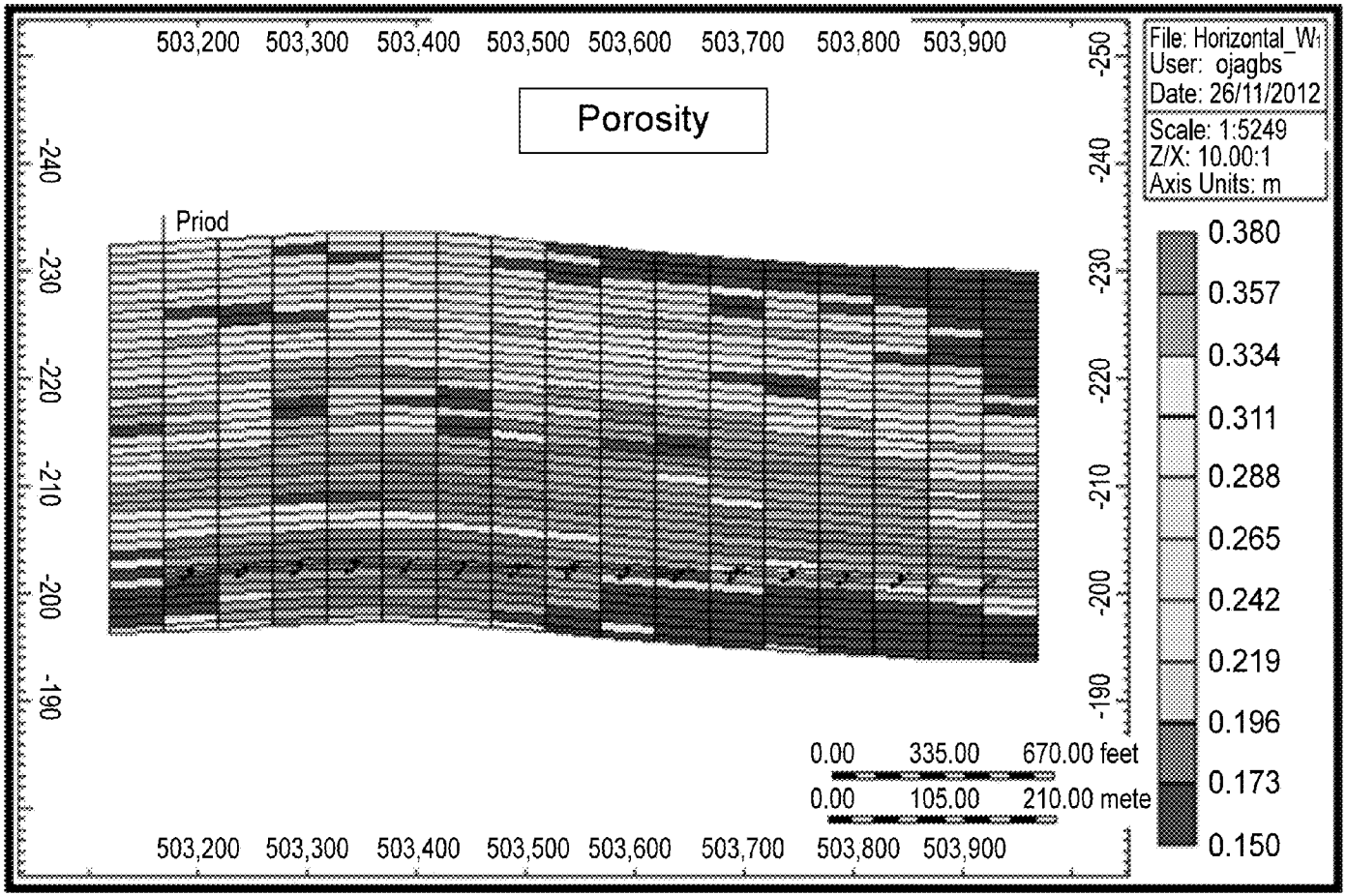
FIG. 6 is a porosity distribution illustration from a simulation test.
Figure 7:
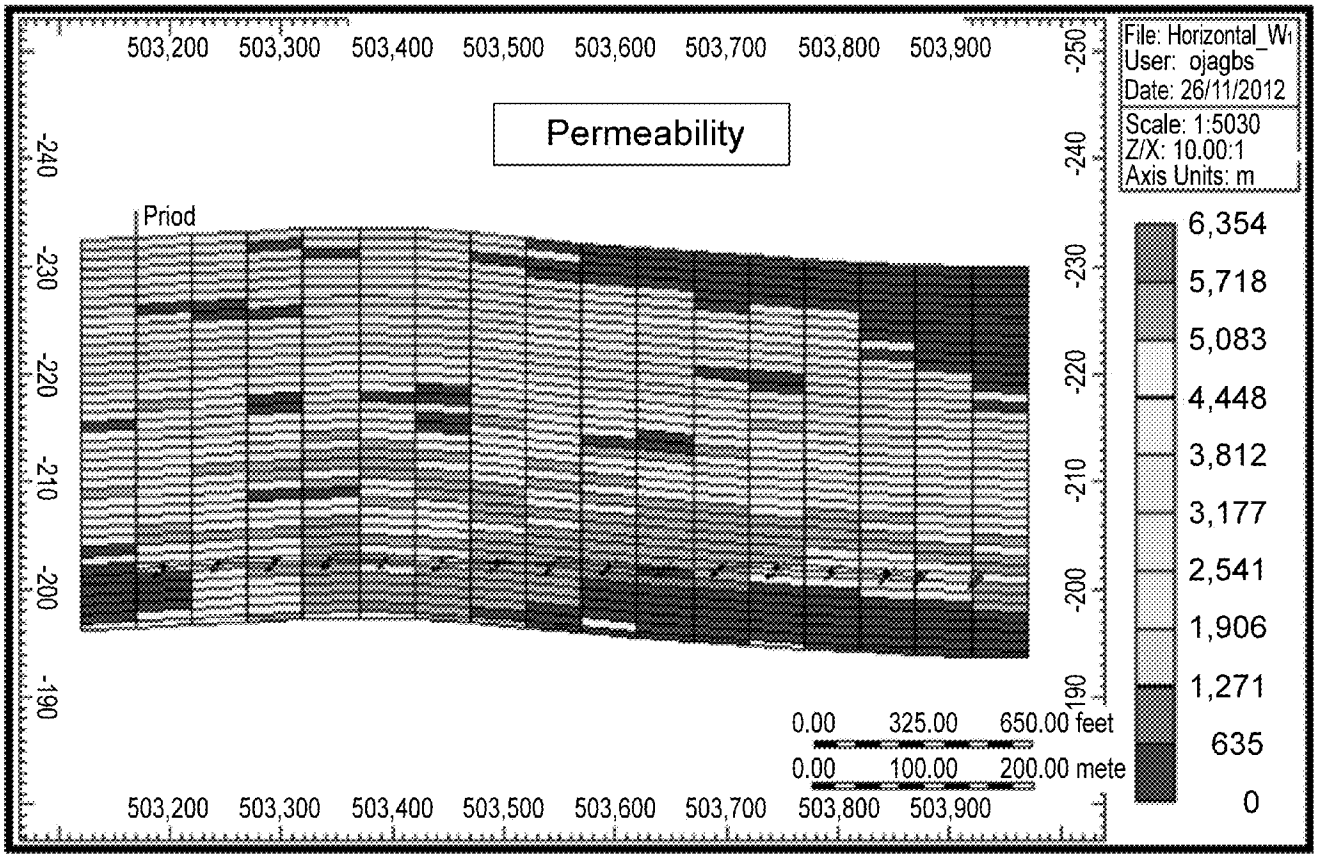
FIG. 7 is a permeability distribution illustration from a simulation test.

Turning now to FIGS. 6 to 16, simulation tests were conducted to assess the potential impact of the present invention when compared to a conventional CSS method. The model contained 17 grid blocks in the x-direction, 31 grid blocks in the y-direction and 41 layers, for a total of 21,607 grid blocks. The dimension for each grid block was 1×50×1 m. The depth to the top of the grid was 194 m. The porosity varied from 15% to 38% as shown in FIG. 6, while horizontal permeability varied from 37 md to 6,354 md as shown in FIG. 7. The vertical permeability was 75% of the horizontal permeability.

Figure 8:
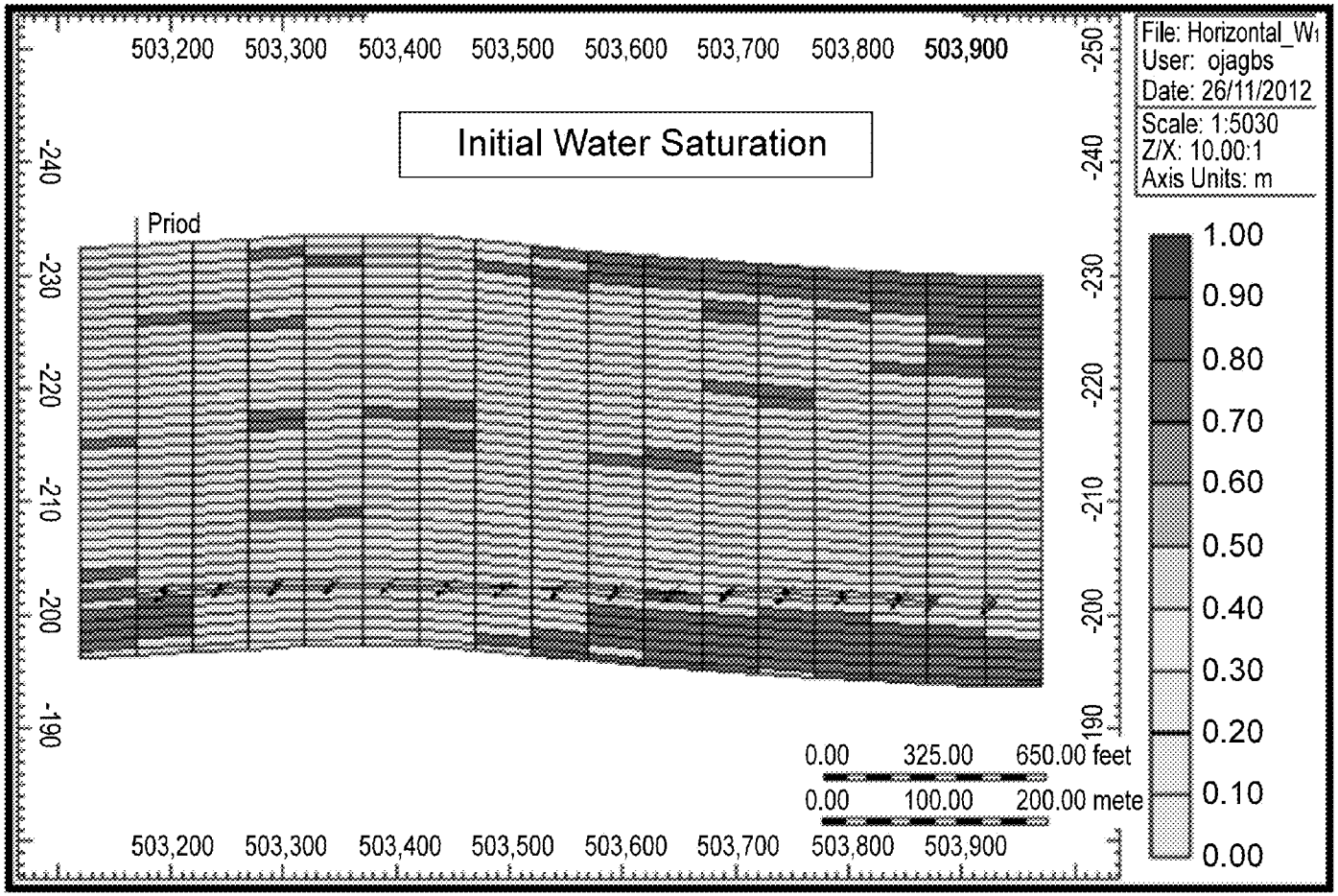
FIG. 8 is an illustration of initial water saturation from a simulation test.
Figure 9:
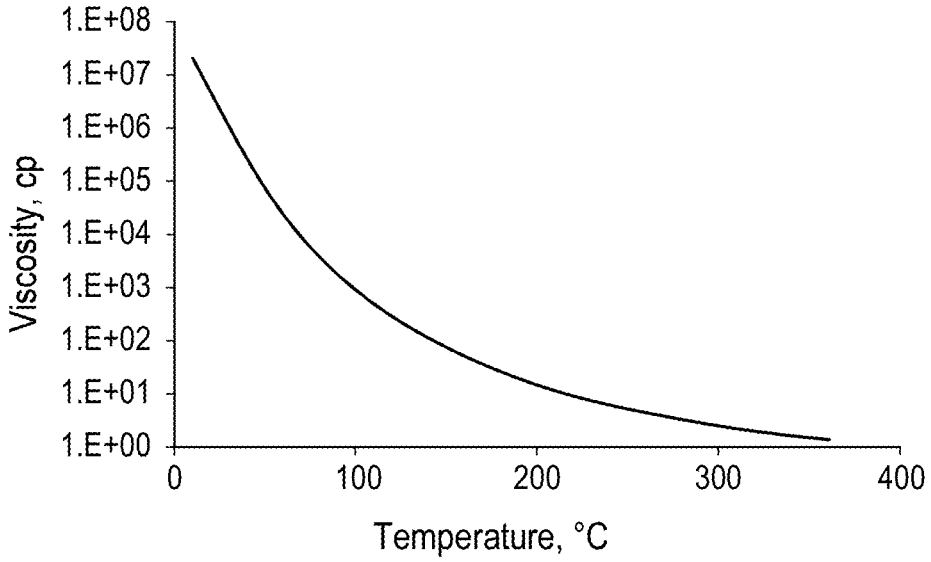
FIG. 9 is a chart illustrating viscosity variation with temperature.

The initial water saturation varied from 0.17 to 0.75 as shown in FIG. 8. The bitumen contained in the reservoir had a viscosity of 3.5 million centipoises at 12 degrees Celsius and pressure of 2700 kPa at a reference depth of 217 m. FIG. 9 illustrates how viscosity will respond to changes in in-situ temperature. The pore volume compressibility was 2.90E-06 $kPa^{-1}$ at a reference pressure of 800 kPa. The relative permeability data used is shown in FIG. 10.

A flow simulation was conducted using Computer Modeling Group's STARS™ thermal reservoir simulator to evaluate the incremental recovery over the base forecast (a conventional CSS process) when a heater was included in the production periods. Proportional heat transfer coefficient (UHTR), used in conjunction with temperature setpoint (TMPSET) of a temperature controller entered for the grid blocks in which the well was completed, was used in modeling the heater. FIG. 11 shows the STARS™ method adopted for the calculation of the heat transfer coefficient giving the grid block volume, reservoir temperature, heat capacity and reference temperature. A steam at 85% quality was injected at a pressure of 6 MPa. A pressure boundary condition was also applied to the model to simulate a fluid loss scenario.

Figure 12:
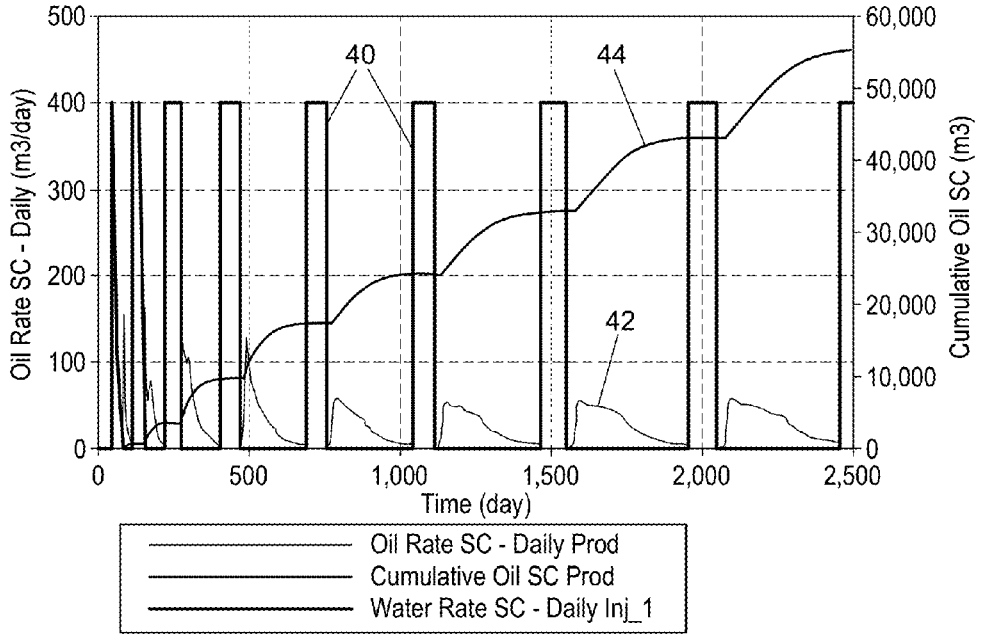
FIG. 12 is a chart illustrating production and injection profiles for a conventional CSS method.
Figure 13:
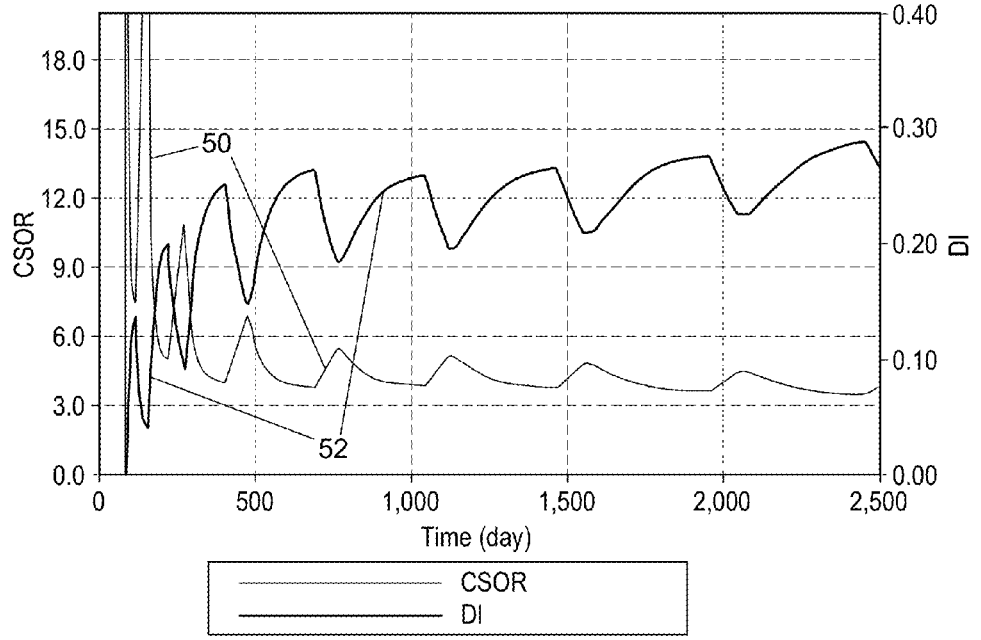
FIG. 13 is a chart illustrating Cumulative Steam Oil Ratio and Depletion Index for a conventional CSS method.
Figure 14:
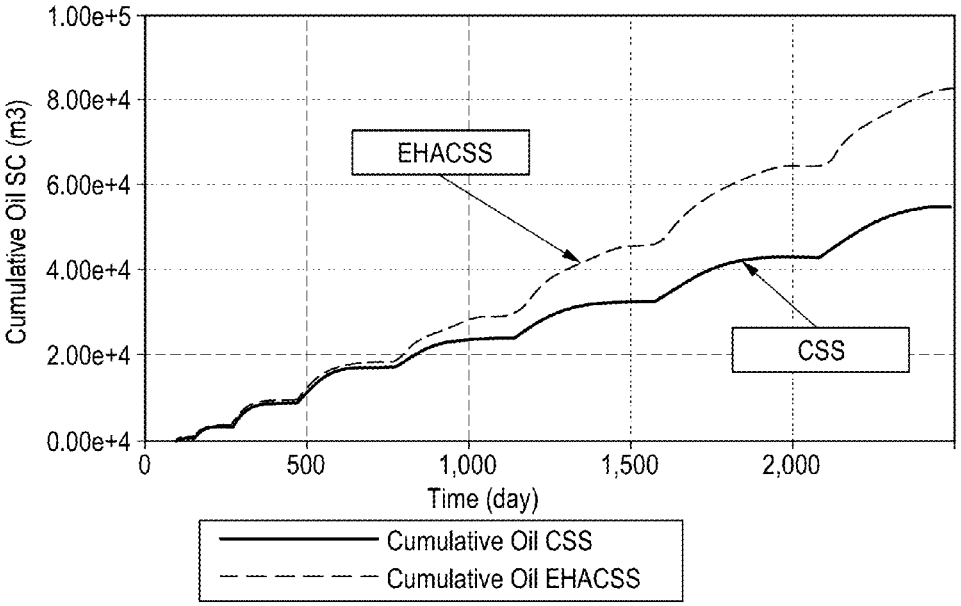
FIG. 14 is a chart illustrating comparative production profiles for conventional CSS and heater-assisted CSS.
Figure 15:
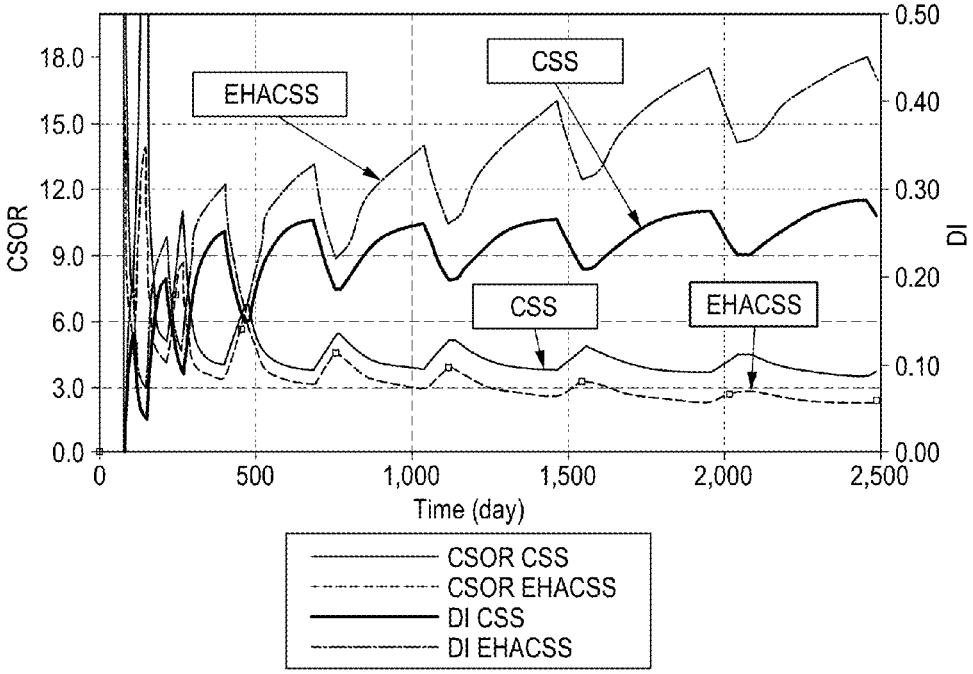
FIG. 15 is a chart illustrating comparative Cumulative Steam Oil Ratio and Depletion Index for conventional CSS and heater-assisted CSS.

FIG. 12 shows the results of the daily and total produced oil 42, 44 and daily injected water 40 under the simulation tests for the conventional CSS method, and FIG. 13 shows the results for the Cumulative Steam Oil Ratio (CSOR) 50 and Depletion Index (DI) 52 for the conventional CSS method. It can be seen from FIGS. 14 and 15 that the heater-assisted CSS method produced an additional 34.09 Mm3 of oil and a lower CSOR which decreased with production. The DI for the heater-assisted CSS method also increased to 0.45 at the end of the simulation forecast compared to the conventional CSS which gave 0.27. A summary of the production results from the simulation exercise is shown in FIG. 16.

As noted above, applying heat to the near-wellbore region of a hydrocarbon reservoir can have significant advantages over CSS alone, such as visco-skin reduction, increased hydrocarbon mobility and reduced viscosity. In addition, embodiments of the present invention may manifest further substantial advantages. For example, limiting heat application to only the soak and production phases of a CSS project can accordingly reduce the operating costs and energy consumption generally, while still obtaining the benefits of the heat application for production. Further, power lines have a certain capacity, and heating can therefore be applied to more wellbores if an intermittent heat application is used as in the present invention. Also, applying certain heat sources (for example radio frequency, resistive heating and inductive heating) during steam injection may actually reduce the efficacy of the heating activity, so the impact of the heating activity can be optimized by selectively not employing it during steam injection. Finally, if heat is applied during steam injection, this could potentially create a back pressure that might negatively impact the effectiveness of the steam injection.

The foregoing is considered as illustrative only of the principles of the invention. The scope of the claims should not be limited by the exemplary embodiment set forth in the foregoing, but should be given the broadest interpretation consistent with the specification as a whole.

The invention claimed is:

1. A method for recovering a hydrocarbon from a reservoir, the method comprising the steps of:

a. drilling at least one well from surface to the reservoir;

b. injecting steam down the at least one well to the reservoir to alter the hydrocarbon to a reduced viscosity;

c. after ceasing injection of the steam, applying heat to a near-wellbore region of the reservoir to maintain the hydrocarbon in the near-wellbore region at the reduced viscosity;

d. after commencing application of the heat, allowing the steam to elevate the temperature of the reservoir and the hydrocarbon while continuing to apply the heat; and e. producing the hydrocarbon to the surface while continuing to apply the heat;

wherein the heat being applied while producing the hydrocarbon is at a temperature sufficient to maintain water in the near-wellbore region in a liquid state based on drawdown pressure; and wherein the temperature is sufficient to maintain the hydrocarbon at the reduced viscosity in the near-wellbore region to a level suitable to enable the producing of the hydrocarbon.

2. The method of claim 1 wherein the hydrocarbon is a heavy hydrocarbon.

3. The method of claim 2 wherein the heavy hydrocarbon is heavy crude oil or bitumen.

4. The method of claim 1 further comprising:

f. after producing the hydrocarbon, ceasing application of the heat.

5. The method of claim 4 further comprising repeating steps b. through f. as desired.

6. The method of claim 1 wherein the at least one well is a single well used for both the step of injecting the steam down the at least one well to the reservoir and the step of producing the at least some of the hydrocarbon to the surface while continuing to apply the heat.

7. The method of claim 1 wherein the at least one well is at least two wells, at least one of which is an injector well and at least one of which is a producer well.

8. The method of claim 1 further comprising the step of maintaining reservoir temperature above 80 degrees Celsius in the near-wellbore region of the reservoir.

9. The method of claim 1 wherein the heat is applied by heat application means selected from the group consisting of electrical heaters, radio frequency waves, electromagnetic waves, and microwaves.

10. A method for recovering a hydrocarbon from a reservoir having at least one injector well therein, the method comprising the steps of:

a. injecting steam down the at least one injector well to the reservoir to alter the hydrocarbon to a reduced viscosity;

b. after ceasing injection of the steam, applying heat to a near-wellbore region of the reservoir to maintain the hydrocarbon in the near-wellbore region at the reduced viscosity; and c. producing the hydrocarbon to the surface while continuing to apply the heat;

wherein the heat being applied while producing the hydrocarbon is at a temperature sufficient to maintain water in the near-wellbore region in a liquid state based on drawdown pressure; and wherein the temperature is sufficient to maintain the hydrocarbon at the reduced viscosity in the near-wellbore region to a level suitable to enable the producing of the hydrocarbon.

11. The method of claim 10 further comprising:

d. after producing the hydrocarbon, ceasing application of the heat.

12. The method of claim 11 further comprising repeating steps a. through d. as desired.

13. The method of claim 10 wherein the hydrocarbon is a heavy hydrocarbon.

14. The method of claim 13 wherein the heavy hydrocarbon is heavy crude oil or bitumen.

15. The method of claim 10 wherein the at least one injector well is a single injector well used for both the step of injecting the steam down the at least one injector well to the reservoir and the step of producing the at least some of the hydrocarbon to the surface while continuing to apply the heat.

16. The method of claim 10 wherein the at least one injector well is at least two injector wells, at least one of which is also used for the step of producing the at least some of the hydrocarbon to the surface while applying the heat.

17. The method of claim 10 further comprising the step of maintaining reservoir temperature above 80 degrees Celsius in the near-wellbore region of the reservoir.

18. The method of claim 10 wherein the heat is applied by heat application means selected from the group consisting of electrical heaters, radio frequency waves, electromagnetic waves, and microwaves.

19. A method for recovering a hydrocarbon from a reservoir having at least one injector well therein, the method comprising the steps of:

a. injecting steam down the at least one injector well to the reservoir;

b. after ceasing injection of the steam, shutting in the at least one injector well and allowing the injected steam to elevate the temperature of the reservoir and the hydrocarbon in the reservoir to alter the hydrocarbon to a reduced viscosity;

c. during shutting in of the at least one injector well, applying heat to a near-wellbore region of the reservoir to maintain the hydrocarbon in the near-wellbore region at the reduced viscosity; and d. producing the hydrocarbon to the surface while continuing to apply the heat;

wherein the heat being applied while producing the hydrocarbon is at a temperature sufficient to maintain water in the near-wellbore region in a liquid state based on drawdown pressure; and wherein the temperature is sufficient to maintain the hydrocarbon at the reduced viscosity in the near-wellbore region to a level suitable to enable the producing of the hydrocarbon.

20. The method of claim 19 wherein the hydrocarbon is a heavy hydrocarbon.

21. The method of claim 20 wherein the heavy hydrocarbon is heavy crude oil or bitumen.

22. The method of claim 19 wherein the at least one injector well is a single well used for both the step of injecting the steam down the at least one injector well to the reservoir and the step of producing the at least some of the hydrocarbon to the surface while applying the heat.

23. The method of claim 19 wherein the at least one injector well is at least two injector wells, at least one of which is also used for the step of producing the at least some of the hydrocarbon to the surface while applying the heat.

24. The method of claim 19 further comprising:

e. after producing the hydrocarbon, ceasing application of the heat.

25. The method of claim 24 further comprising repeating steps a. through e. as desired.

26. The method of claim 19 further comprising the step of maintaining reservoir temperature above 80 degrees Celsius in the near-wellbore region of the reservoir.

27. The method of claim 19 wherein the heat is applied by heat application means selected from the group consisting of electrical heaters, radio frequency waves, electromagnetic waves, and microwaves.

* * * * *